US005512737A

United States Patent [19]

Miklos

[11] Patent Number: 5,512,737

[45] Date of Patent: Apr. 30, 1996

[54] OVEN LINER FOR DIELECTRIC OVEN

[75] Inventor: Joseph P. Miklos, Germantown, Ohio

[73] Assignee: Henny Penny Corporation, Eaton, Ohio

[21] Appl. No.: 239,523

[22] Filed: May 9, 1994

[51] Int. Cl.[6] ..... H05B 6/54

[52] U.S. Cl. ..... 219/771; 219/780; 219/757; 219/733; 99/358; 99/DIG. 14

[58] Field of Search ..... 219/771, 780, 219/774, 756, 757, 733; 99/358, 451, DIG. 14

[56] References Cited

U.S. PATENT DOCUMENTS

| | | | |
|---|---|---|---|
| 2,474,420 | 6/1949 | Himmel . | |
| 2,512,311 | 6/1950 | Davis . | |
| 2,542,589 | 2/1951 | Stanton et al . | |
| 2,888,542 | 5/1959 | Mork | 219/756 |
| 3,082,710 | 3/1963 | Holland . | |
| 3,591,751 | 7/1971 | Goltsos . | |
| 3,701,872 | 10/1972 | Levinson | 219/730 |
| 3,753,651 | 8/1973 | Boucher | 219/756 |
| 3,845,270 | 10/1974 | Widugkis, Jr. | 219/733 |
| 3,866,255 | 2/1975 | Serota . | |
| 4,010,341 | 3/1977 | Ishammar . | |
| 4,262,183 | 4/1981 | Smith et al. | 219/757 |
| 4,296,298 | 10/1981 | MacMaster et al. . | |
| 4,303,820 | 12/1981 | Stottmann et al. . | |
| 4,481,395 | 11/1984 | Smith et al. | 219/756 |
| 4,522,834 | 6/1985 | Miyahara . | |
| 4,812,609 | 3/1989 | Butot . | |
| 4,910,371 | 3/1990 | Brun et al. | 219/771 |
| 4,978,826 | 12/1990 | DeRuiter et al. . | |
| 4,980,530 | 12/1990 | Butot . | |

FOREIGN PATENT DOCUMENTS

| | | |
|---|---|---|
| WO8912947 | 12/1989 | European Pat. Off. . |

*Primary Examiner*—Philip H. Leung
*Attorney, Agent, or Firm*—Baker & Botts

[57] ABSTRACT

A dielectric oven for heating a product with a tray includes a housing having an access, wherein the housing defines a heating cavity. The oven includes an oven liner which substantially conforms to the interior shape of the heating cavity and forms a liner cavity within the heating cavity. The liner is made from a non-electrically conductive material which may have a low dielectric constant, a low dielectric loss tangent, and a melting point of at least about 225° F. (107° C.). The liner forms a vaportight boundary between the liner cavity and the heating cavity. The liner material may be a thermoplastic resin selected from the group consisting of polysulphone, polyester, and polycarbonate resins. The liner material may be reinforced with, for example, glass fibers, such as in fiberglass reinforced polyester resin. The housing and the liner may have at least one air intake port and at least one exhaust port. At least a pair of contacts may project into the interior of the oven liner. An electromagnetic energy source is coupled to and supplies current to each of the contacts. The oven also includes at least first and second electrodes each of which are coupled to one of the contacts and the electrodes bracket the product when placed in the oven for heating.

28 Claims, 5 Drawing Sheets

OVEN LINER FOR DIELECTRIC OVEN

BACKGROUND OF THE INVENTION

1. Field of the Invention

This invention relates to an oven liner for use in a dielectric oven for heating a product, such as for cooking foodstuffs. Particularly, it relates to an oven liner that fits within a heating cavity of the dielectric oven and prevents arcing and flashover during operation of the oven. Further, such oven liners may direct cooking vapors, such as steam or vaporized oils or fats, out of the oven to improve heating efficiency.

2. Description of the Related Art

Commercial ovens are commonly convection ovens utilizing a slow convection heating process. Dielectric ovens, however, heat a product due to the electric, i.e., dielectric, losses caused when the product is placed in a varying electromagnetic field. If the product is homogeneous and the electromagnetic field is uniform, heat may develop uniformly and simultaneously throughout the mass of the product.

Ovens utilizing dielectric high frequency heating are known, and examples of such ovens are disclosed in U.S. Pat. Nos. 4,812,609 to Butot; 4,978,826 to DeRuiter et al.; and 4,980,530 to Butot, which are incorporated herein by reference. Such ovens may operate in a frequency range of about 2 to 40 Mhz. Further, dielectric ovens may be fitted with guide racks for stacking a plurality of trays carrying the product to be heated within an electromagnetic field or fields.

Dielectric ovens may utilize an oscillating circuit or circuits utilizing specially designed power sources, e.g., power tubes. Such oscillating circuits generally provide a substantially fixed distribution of voltage and power within a heating cavity. Thus, longer heating times may be required for heating greater volumes of products. Further, frequencies at which the ovens are operated are dependent on the characteristics of the product being heated.

A dielectric oven may include a heating cavity for receiving a tray containing the product during heating, a high frequency oscillating circuit, a power source for generating a high frequency electric signal, and electrodes for producing an electromagnetic field in the cavity to transfer power from the oscillating circuit to the product. The oven may be broadly operable for increasing the power transferred from the oscillating circuit to the product without increasing the operating voltage of the power source or the frequency of its operation. Further, such ovens may include a plurality of oscillating circuits having substantially similar resonant frequencies.

Each of the oscillating circuits may also include an inductance and a capacitance. The capacitance may include a pair of capacitors respectively formed between two electrodes of the oscillating circuit and additional plates or, for example, wall portions of the heating cavity. Preferably, the two electrodes of each oscillating circuit are oriented to produce an open electromagnetic field therebetween. In this configuration, electrode pairs form a pair of interconnecting load capacitors between the electrodes of the oscillating circuits. The dielectric of the load capacitors includes the product placed between the electrodes of each capacitor. The open electromagnetic field has a power intensity distribution determined by the dielectric characteristic of the product, while permitting the power source to operate at a substantially constant power level. Further, the use of the load capacitors as connectors between oscillators isolates the frequency of oscillation of the oscillating circuits from the effects of the dielectric characteristics of the product.

The product may be bracketed by the plates of a capacitor, i.e., the electrodes, in the oscillating circuit. The oscillating circuit may be arranged to provide a voltage across the capacitor which is twice the voltage across the power source, thus, permitting the doubling of distance between the electrodes without reducing the electromagnetic field strength. This allows the quantities of the product which may be heated between the electrodes to be increased.

When a product is heated in a dielectric oven or when the heating fluid surrounding the product is heated, e.g., boiled, to heat the product, vapors are produced in the heating cavity. Referring to FIG. 1, dielectric oven designs may include a housing 200 defining a heating cavity 202. Such oven designs have an access (not shown) through which trays 203 may be inserted and removed from the oven. A control unit 204 regulates the delivery of current from an electromagnetic energy source, such as power tube 205, to electrodes 206*a* and 206*b*. An insulated wall 207 of cavity 202 forms the dielectric between capacitors formed by electrodes 206*a* and 206*b* and grounded portions of housing 200.

Arcing or flashover may occur if the vapors are allowed to reach the capacitor plates, e.g., the oven housing 200. Arcing or arc discharge is a direct electrical current between two electrodes in a vapor, having a high current density and a relatively low voltage drop. Flashover is an electrical discharge around or over the surface of an insulator. Further, if vapors are allowed to pass from cavity 202 into the portion of the oven containing the tube and the control unit, the oven may be seriously damaged.

The presence of vapors, such as steam, in dielectric ovens is undesirable for other reasons. Steam is highly corrosive and may damage metal surfaces in the oven. Moreover, vapors may condense on the capacitor plates, e.g., electrodes, and foul their surfaces. Such vapors also may cause localized pitting or general oxidation which further reduces efficiency. The production of vapors within the electromagnetic field also may waste energy due to dielectric losses in the vapor cloud.

SUMMARY OF THE INVENTION

Thus, a need has arisen for an oven liner which prevents vapors from reaching the capacitor plates. It is an object of this invention to separate the housing from the product with a liner, so that the capacitor plates are shielded from the vapors produced when the product is heated. It is an advantage of this invention that arcing and flashover may be significantly reduced or eliminated. It is a feature of this invention that an oven liner creates a vaportight boundary which reduces or eliminates arcing and flashover.

It is another object of the invention that the liner is made from non-electrically conductive material and does not interfere with the electromagnetic field produced in the dielectric oven. It is an advantage of this invention that neither the liner nor its components cause significant energy losses. It is a feature of this invention that the liner may be made from a material with a low dielectric constant, e.g., a dielectric constant less than about 4. Further, it may have a low dielectric loss tangent, e.g., less than about 0.015 at temperatures less than about 600° F. (316° C.). It is another feature of this dielectric oven that the material may be a thermoplastic resin selected from the group consisting of polysulphone, polyester, and polycarbonate resins. It is an additional feature of this invention that the oven liner has a melting point greater than the boiling point of a heating fluid. For example, if water is used as a heating fluid, the melting point for the liner is greater than about 225° F. (107° C.).

It is yet another object of this invention that vapors are exhausted from the housing. It is an advantage of this embodiment that the exposure of capacitor plates is minimized, and vapors are inhibited from condensing on oven parts. It is a feature of this invention that the oven liner may be equipped with exhaust guides and fans to expel vapors from the oven, intake ports and fans to draw drier air into the oven to replace exhausted air and vapor, and drain sumps and guides to collect any liquid that may condense within the heating cavity or splash from the trays.

An embodiment of the present invention is a dielectric oven for heating a product within a tray. The oven includes a housing having an access and an access cover. The housing defines a heating cavity, which has a liner conforming to the cavity, made from a non-electrically conductive material, and forming a vaportight boundary between the heating cavity and the housing. The lining may conform substantially to the shape of the heating cavity. At least a pair of contacts project into the cavity, and an electromagnetic energy source, such as a source of alternating current, is coupled to and supplies current to each of the contacts. The oven also includes at least first and second electrodes, each of which is coupled to one of the contacts, such that the electrodes bracket the product. In yet another embodiment, the housing may also have at least one exhaust port or at least one air intake port and at least one exhaust port.

In a further embodiment, a dielectric oven for heating a product within a tray includes a housing which has a top wall, a bottom wall, and at least one side wall and includes a housing access and a housing access cover. The housing defines a heating cavity. The oven also includes an oven liner made from a non-electrically conductive material and having a liner top wall, a liner bottom wall, and at least one liner side wall, which substantially conform to the housing walls. The liner also includes a liner access and a liner access cover, which substantially conform to the housing access and housing access cover, respectively. The liner defines a liner cavity within the heating cavity and forms a vaportight boundary between the liner cavity and the heating cavity. The oven also includes at least a pair of contacts, and an electromagnetic energy source is coupled to and supplies current to each of the contacts. At least first and second electrodes, each of which are coupled to one of contacts, bracket the product.

In still another embodiment, the dielectric oven for heating a product within a tray includes a housing having a top wall, a bottom wall, and at least one side wall, and a housing access and a housing access cover. The housing defines a heating cavity. The oven also includes an oven liner made from a non-electrically conductive material. The liner has a liner top wall, a liner bottom wall, and at least one liner side wall, which substantially conform to the housing walls, and a liner access and a liner access cover, which conform to the housing access and the housing access cover, respectively. At least one intake port is located in the at least one housing and at least one liner side walls. At least one exhaust port is located in the housing and liner top walls. The oven has at least a pair of contacts projecting into the liner cavity, and an electromagnetic energy source is coupled to and supplies current to each of the contacts. The oven also includes at least first and second electrodes, each of which are substantially parallel to each other and bracket the product. Each of the at least first and second electrodes is coupled with one of said contact.

Other objects, advantages, and features will be apparent when the detailed description of the invention and the drawings are considered.

DETAILED DESCRIPTION OF THE INVENTION AND PREFERRED EMBODIMENTS

Figure 2:
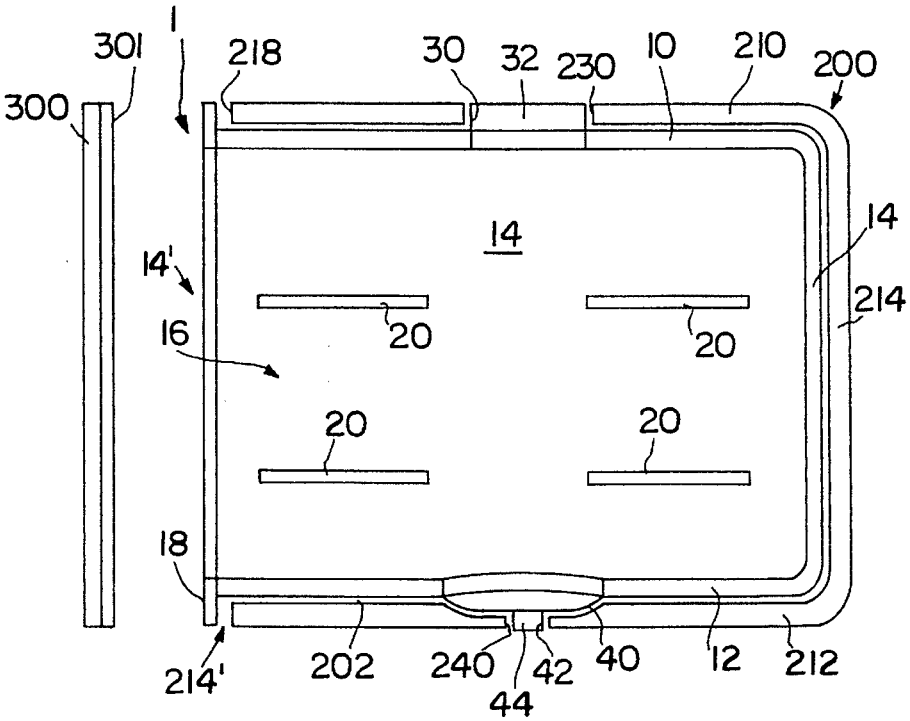
FIG. 2 depicts a longitudinal cross-sectional view of an oven liner and housing.

Referring to FIG. 2, a housing 200 is depicted which includes a top wall 210, a bottom wall 212, and three side walls 214 only one of which is shown. Housing 200 has an housing access 214' to allow access to a heating cavity 202. An oven liner 1 is shown which includes a top wall 10, a bottom wall 12, and three side walls 14 only two of which are shown. Oven liner 1 conforms to the walls of housing 200. Oven liner 1 has a liner access 14' to allow access to the liner cavity 16.

Liner access 14' is surrounded by a lip 18 which abuts an edge 218 of housing 200 surrounding housing access 214'. Lip 18 positions liner 1 with respect to housing 200. Housing 200 includes an access cover 300 having an access cover liner 301. Lip 18 also seals liner access 14' and housing access 214' with access cover liner 301 of access cover 300.

Liner 1 is made from a non-conductive material having a low, dielectric loss constant, a low dielectric loss tangent, and a melting point of at least about 225° F. (107° C.). A suitable liner material is a thermoplastic resin selected from the group consisting of polysulphone, polyester, and polycarbonate resins. For example, the liner may be made from LEXAN® thermoplastic resin, a polycarbonate resin manufactured by DuPont Co. The liner material may be reinforced with glass fibers or the like to form, for example, fiberglass reinforced polyester resin. Liner 1 may be made as a single molded unit or in separate wall components which may be assembled to form a vaportight boundary between liner cavity 16 and housing cavity 202.

Access cover 300 may be fitted with a glass or acrylic viewing port (not shown). Preferably, access cover 300 is made from the same material as housing walls 210, 212, and 214, and access liner 301 is made from the same material as liner walls 10, 12, and 14. Access cover 300 may seal housing 200 by means of bolts, by a latch and hinges, or the like. When access cover 300 seals housing 200 a vaportight boundary is formed between liner 1 and access liner 301 and housing 200 and access cover 300.

Housing 200 also includes an housing exhaust port 230 located in top wall 210 and a drain port 240 located in bottom wall 212. Liner 1 includes a liner exhaust port 30 and an exhaust guide 31 formed in liner top wall 10 which extends through housing exhaust port 230. Housing exhaust port 230 and liner exhaust port 30 and exhaust guide 31 define an exhaust conduit 32 through which vapors produced during the heating of products within the oven are exhausted from the oven. Similarly, a drain port 240 is located in housing bottom wall 212, and liner 1 also includes a sump 40 and a drain guide 42. Drain port 240, sump 40, and drain guide 42 define a drain conduit 44 by which liquids splashing or spraying from the trays or condensing on liner walls 10, 12, and 14 may drain from liner cavity 16. Exhaust guide 31 and sump 40 and drain guide 42 may be made from the same material as liner 1. Further, these components may be formed integral with components of liner 1, or they may be formed separately and affixed to liner 1. If these components are formed separately, connection points between these components and liner 1 are vaportight to maintain the vaportight boundary between liner cavity 16 and heating cavity 202.

Figure 1:
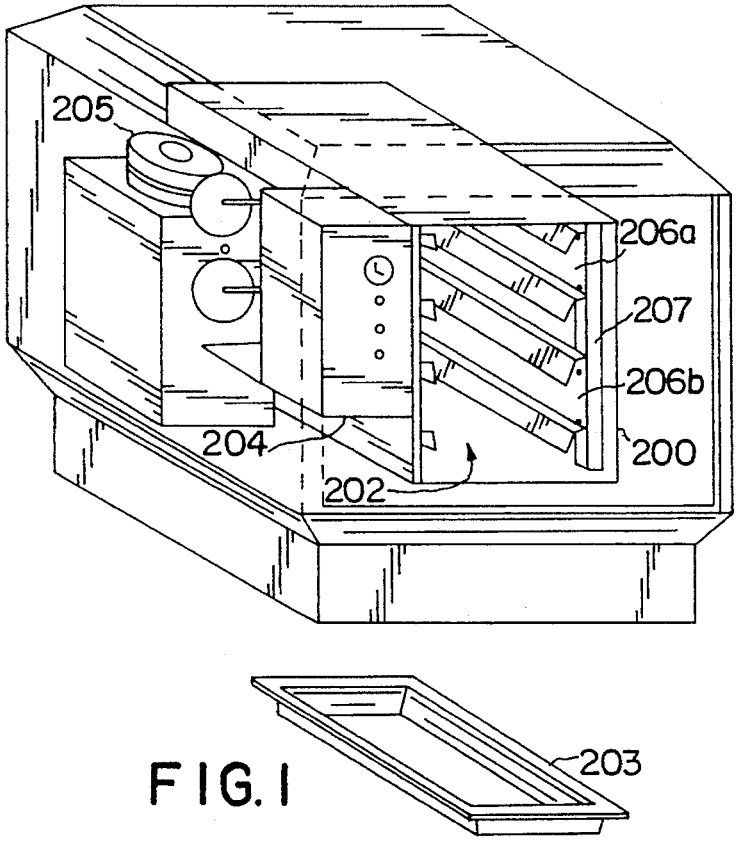
FIG. 1 depicts a perspective view of a dielectric oven of the prior art.
Figure 3:
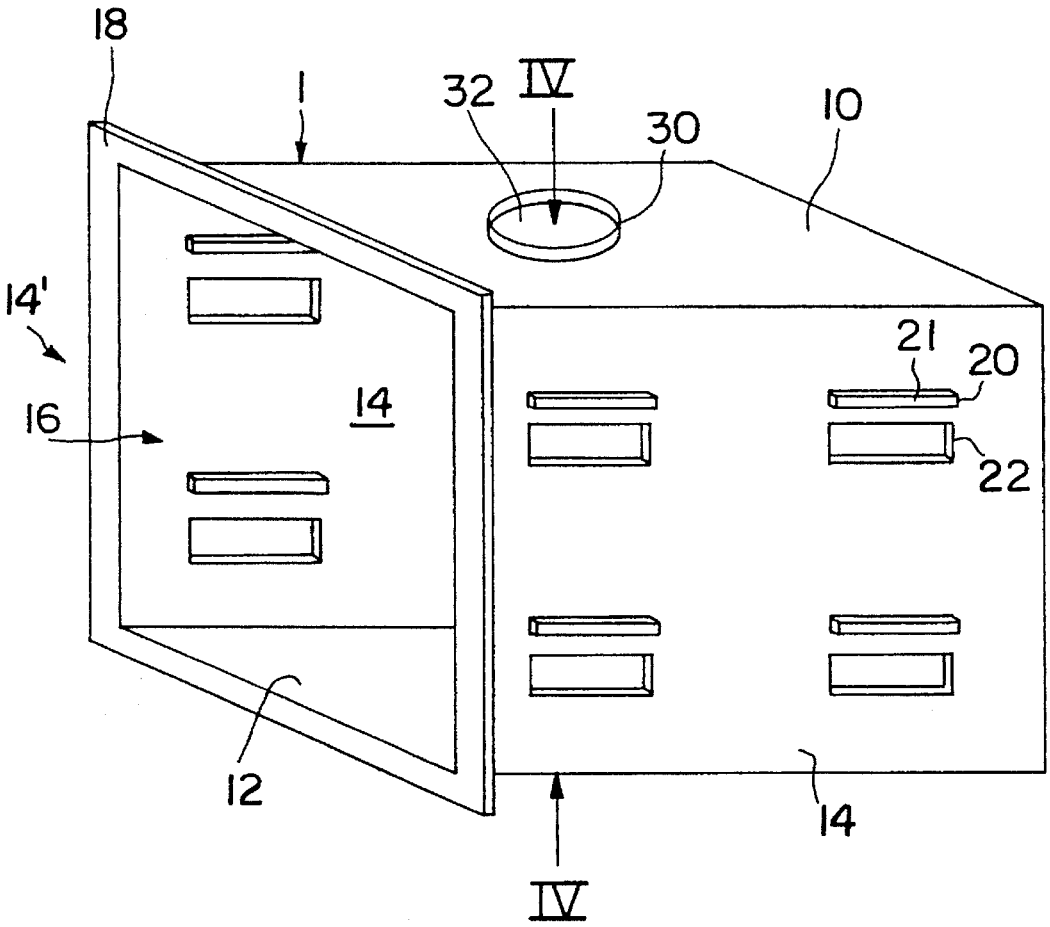
FIG. 3 depicts a perspective view of an oven liner, similar to that of FIG. 2, with contacts and air intake ports.

FIG. 2 also depicts contact openings 20 through which contacts (not shown) enter liner cavity 16. Referring to FIG. 3, liner 1 is shown further including contacts 21 extending through side wall 14 into liner cavity 16. Liner 1 also includes air intake ports 22. Preferably, intake ports 22 are located below contact openings 20. If electrodes, such as those disclosed in FIG. 1, are coupled to contacts 21, air flowing through intake ports 22 may be directed against the electrodes and thereby reduces the amount of vapor contacting the electrodes. Thus, fouling, pitting, and oxidation of the electrodes caused by cooking vapors may be reduced.

Figure 4:
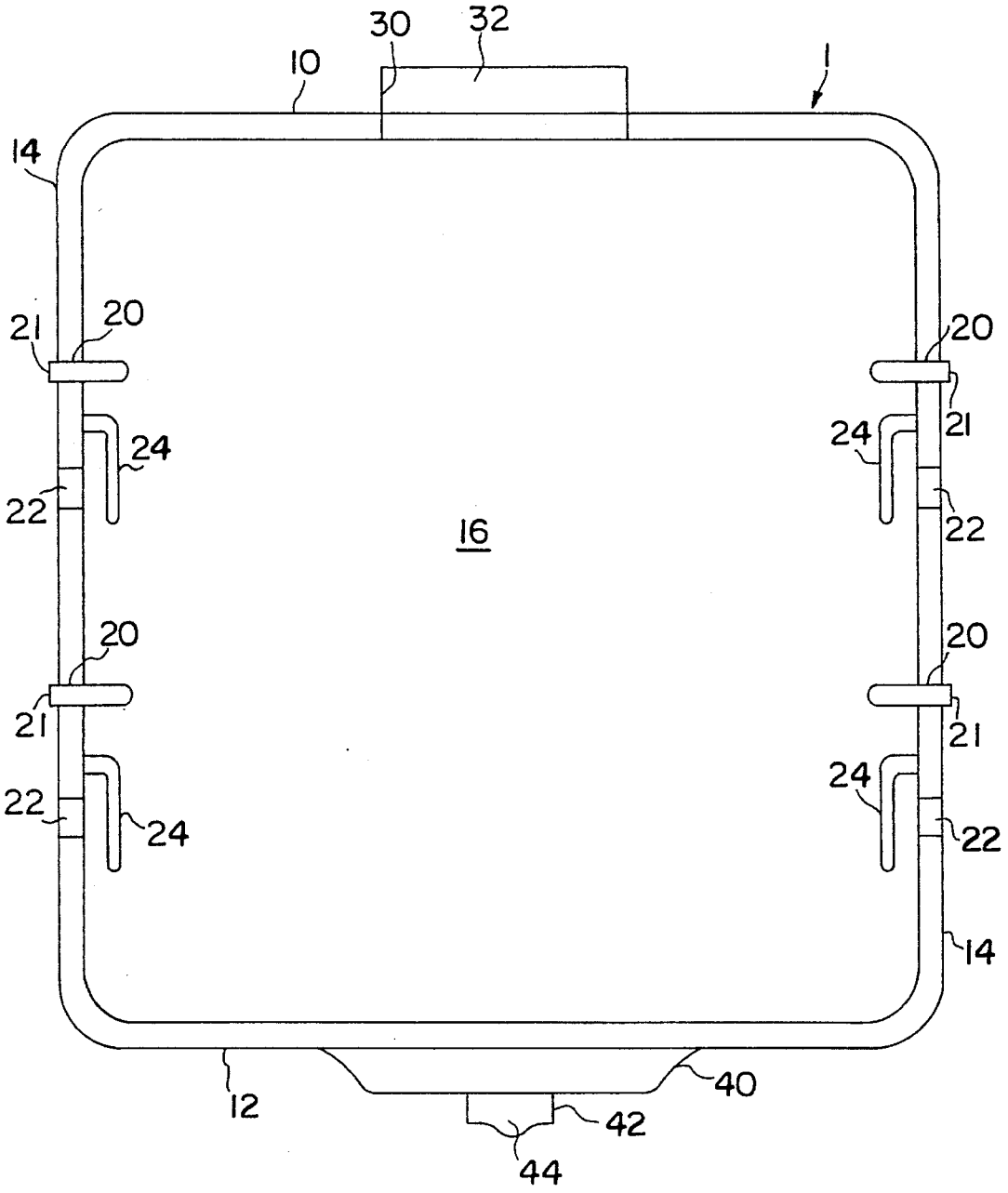
FIG. 4 depicts a transverse cross-sectional view of an oven liner, similar to that of FIG. 3 along line IV—IV, with contacts and air intake ports and louvers.

In addition, as depicted in FIG. 4, intake ports 22 may be fitted with louvers 24 which prevent heating fluids or grease released during product heating from splashing or spraying from the trays through intake ports 22. Because louvers 24 extend into liner cavity 16, louvers 24 also are made from a non-electrically conductive material having a low dielectric loss constant, a low dielectric loss tangent, and a melting point of at least about 225° F. (107° C.). Suitable louver material includes a thermoplastic resin selected from the group consisting of polysulphone, polyester, and polycarbonate resins. For example, liner 1 and louvers 24 may be made from LEXAN® thermoplastic resin, a polycarbonate resin manufactured by DuPont Co.

Figure 5:
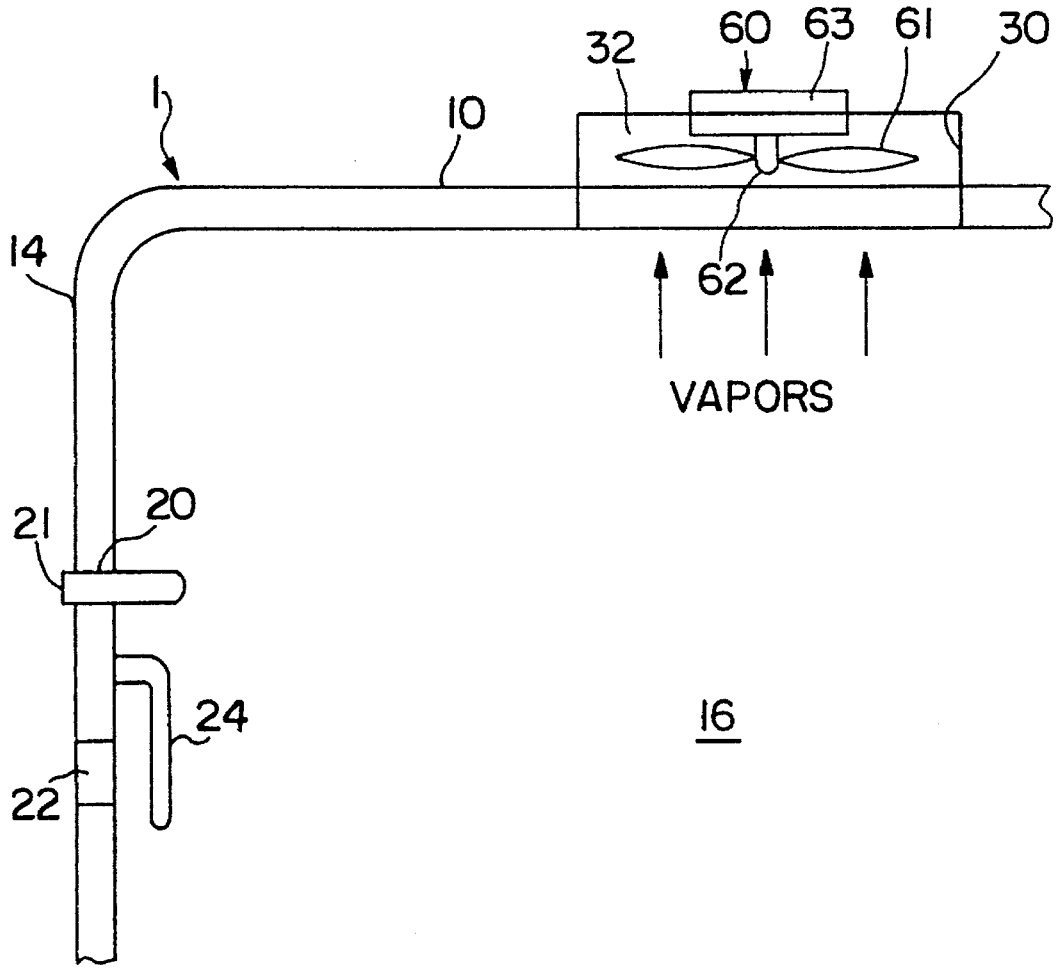
FIG. 5 depicts an enlarged, partial, transverse cross-sectional view of an oven liner similar to that of FIG. 4, equipped with a exhaust fan.
Figure 6:
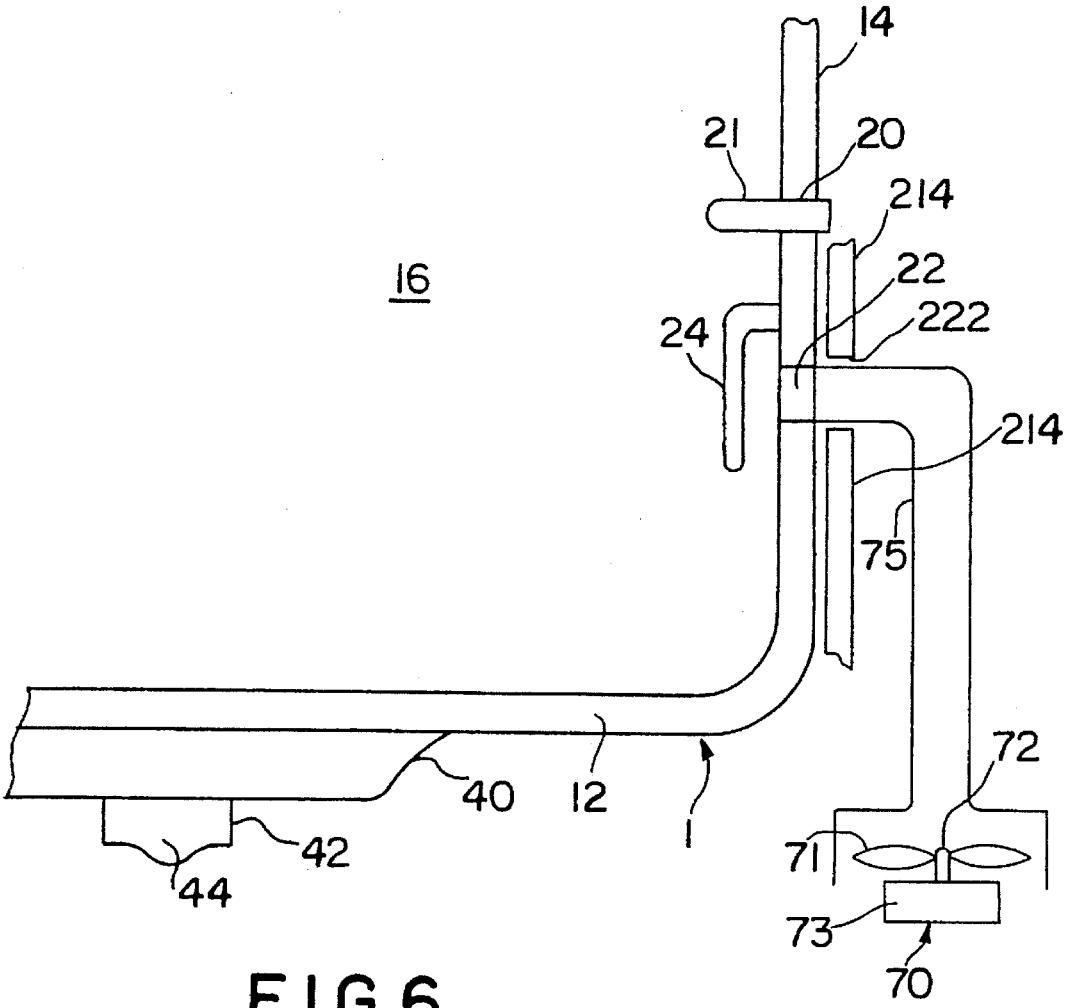
FIG. 6 depicts an enlarged, partial, transverse cross-sectional view of an oven liner similar to that of FIG. 4, equipped with an air intake fan.

Referring to FIGS. 5 and 6, vapor exhaust from the oven and air flow through the oven may be increased by employing an exhaust fan 60 to expel vapors from liner cavity 16 or an intake fan 70 to force air into liner cavity 16, or both. As shown in FIG. 5, exhaust fan 60 includes fan blades 61, a drive shaft 62, and a motor 63 and may be placed within exhaust guide 31 to take advantage of the natural updraft created by the rising heated vapors. It is preferable that fan blades 61 and drive shaft 62 be made of materials having a low dielectric constant and a low dielectric loss tangent. Because exhaust fan 60 may be located in exhaust guide 31, exhaust fan 60 may be subject to the highest temperatures associated with heating products in the oven. Therefore, components of exhaust fan 60 may have a higher melting point than liner 1 or exhaust guide 31, or both. Moreover, if exhaust fan motor 63 includes metal or electrically conductive or magnetic components, motor 63 is isolated from the electromagnetic field produced within liner cavity 16.

FIG. 6 depicts intake fan 70 including fan blades 71, a drive shaft 72, and a motor 73. Intake fan 70 may be placed in an intake guide 75 which allows fan 70 to be located remotely from liner cavity 16. Intake guide 75 passes through a housing intake port 222 and a liner intake port 22. Intake guide 75 is preferably made from a material similar to that used to make liner 1, e.g., having a low dielectric constant, a low dielectric loss tangent, and a melting point of at least about 225° F. (107° C.). However, as long as intake fan 70 is remotely located from liner cavity 16, the composition of intake fan 70 need not be limited to materials chosen in view of their effect on an electromagnetic field. Nevertheless, if intake fan 70 is located near liner 1, it is preferable that fan blades 71 and drive shaft 72 are made of materials having a low dielectric constant and a low dielectric loss tangent. Moreover, as discussed above with respect to fan motor 63, if fan motor 73 includes metal or electrically conductive or magnetic components, motor 73 is isolated from the electromagnetic field produced within liner cavity 16. Similarly, referring again to FIG. 5, exhaust guide 31 may be extended to allow exhaust fan 60 to be located remotely from liner cavity 16.

The dimensions of the oven liner 1 and the other components discussed above may be varied to conform to various dielectric oven sizes. Although a detailed description of the present invention is provided above, it is to be understood that the scope of the invention is not be limited thereby but is to be determined by the claims which follow.

I claim:

1. A dielectric oven for heating a product within a tray, said oven comprising:

a housing including an access and a housing access cover and defining a heating cavity therein, wherein said housing has a liner conforming to said cavity and said liner is substantially in contact with said housing, made from a non-electrically conductive material and forming a vaportight boundary between said heating cavity and said housing;

at least a pair of contacts projecting through said housing and said liner and into said cavity, such that said liner forms said vaportight boundary around said contacts;

an electromagnetic energy source located outside of said housing and said liner coupled to and supplying current to each of said contacts and capacitor plates located between said housing and said liner; and at least first and second electrodes located within said cavity, each of which is coupled to one of said contacts, bracketing said product.

2. The dielectric oven of claim 1, wherein said material has a low dielectric constant.

3. The dielectric oven of claim 1, wherein said material has a low dielectric loss tangent.

4. The dielectric oven of claim 1, wherein said material has a melting point of at least 225° F. (107° C.).

5. The dielectric oven of claim 1, wherein said material is a thermoplastic resin selected from the group consisting of polysulphone, polyester, and polycarbonate resins.

6. The dielectric oven of claim 1, wherein said housing and said liner have at least one air intake port and at least one exhaust port.

7. The dielectric oven of claim 6, wherein said housing comprises a top wall, a bottom wall, and at least one side wall, wherein said at least one air intake port is located in said at least one side wall and said at least one exhaust port is located in said top wall.

8. The dielectric oven of claim 6, wherein said liner has at least one exhaust fan for exhausting vapors through said at least one exhaust port.

9. The dielectric oven of claim 6, wherein said liner has at least one air intake fan for forcing air through said at least one air intake port.

10. A dielectric oven for heating a product within a tray, said oven comprising:

a housing which has a top wall, a bottom wall, and at least one side wall and includes a housing access and a housing access cover, defining a heating cavity;

a oven liner made from a non-electrically conductive material and having a liner top wall, a liner bottom wall, and at least one liner side wall, which substantially conform to and are substantially in contact with said housing walls, including a liner access and a liner access cover, which substantially conform to said housing access and said housing access cover, respectively said liner defining a liner cavity within said heating cavity and forming a vaportight boundary between said liner cavity and said heating cavity;

at least a pair of contacts through said housing and said liner and into said cavity, such that said liner forms said vaportight boundary around said contacts;

an electromagnetic energy source located outside of said housing and said liner coupled to and supplying current to each of said contacts and capacitor plates located between said housing and said liner; and at least first and second electrodes located within said cavity, each of which is coupled to one of said contacts, bracketing said product.

11. The dielectric oven of claim 10, wherein said contacts project through said at least one housing and liner side walls into said liner cavity.

12. The dielectric oven of claim 11, wherein at least one exhaust guide is formed in said liner top wall, wherein each of said at least one exhaust guide extends through a corresponding one of said at least one exhaust port.

13. The dielectric oven of claim 12, wherein said material is a thermoplastic resin selected from the group consisting of polysulphone, polyester, and polycarbonate resins.

14. The dielectric oven of claim 12, wherein said material is fiberglass reinforced polyester resin.

15. The dielectric oven of claim 12, wherein said liner has at least one exhaust for exhausting vapors through said at least one exhaust port.

16. The dielectric oven of claim 10, further comprising at least one intake port located in said at least one housing and liner side walls and at least one exhaust port located in said housing and liner top walls.

17. The dielectric oven of claim 16, wherein said liner has at least one air intake fan for forcing air through said at least one air intake port.

18. The dielectric oven of claim 16, wherein each of said at least one air intake ports is fitted with a louver.

19. A dielectric oven for heating a product within a tray, said oven comprising:

a housing having a top wall, a bottom wall, at least one side wall, a housing access, and a housing access cover, wherein said housing defines a heating cavity;

an oven liner made from a non-electrically conductive material and having a liner top wall, a liner bottom wall, and at least one liner side wall, wherein said oven liner walls substantially conform to and are substantially in contact with said housing walls, and including a liner access and a liner access cover which conform to said housing access and said housing access cover, respectively, said liner defining a liner cavity within said heating cavity and forming a vaportight boundary between said liner cavity and said heating cavity;

at least one drain port located in said housing bottom wall and at least one drain guide formed in said liner bottom wall;

at least one intake port located in said at least one housing and liner side walls and at least one exhaust port located in said housing and liner top walls;

at least a pair of contacts projecting through said housing and said liner and into said liner cavity, such that said liner forms said vaportight boundary around said contacts;

an electromagnetic energy source located outside of said housing and said liner coupled to and supplying current to each of said contacts and capacitor plates located between said housing and said liner; and at least first and second electrodes located within said cavity, each of said electrodes are substantially parallel to each other bracket said product and each of said at least first and second electrodes is coupled with one of said contacts.

20. The dielectric oven of claim 19, wherein at least one exhaust guide is formed in said liner top wall, wherein each of said at least one exhaust guide extends through a corresponding to one of said at least one exhaust port.

21. The dielectric oven of claim 19, wherein said material is a thermoplastic resin selected from the group consisting of polysulphone, polyester, and polycarbonate resins.

22. The dielectric oven of claim 19, wherein said material is fiberglass reinforced polyester resin.

23. The dielectric oven of claim 19, wherein said at least one exhaust fan for exhausting vapors through said at least one exhaust port.

24. The dielectric oven of claim 19, wherein said at least one air intake fan for forcing air through said at least one air intake port.

25. The dielectric oven of claim 19, wherein each of said at least one air intake ports is fined with a louver.

26. A dielectric oven for heating a product within a tray, said oven comprising:

a housing including an access and a housing access cover and defining a heating cavity therein, wherein said housing has a liner conforming to said cavity and said liner is in contact with said housing, made from a non-electrically conductive material and forming a vaportight boundary between said heating cavity and said housing;

at least a pair of contacts projecting through said housing and said liner and into said cavity, such that said liner forms said vaportight boundary around said contacts;

an electromagnetic energy source including capacitor plates located outside of said housing and said liner coupled to and supplying current to each of said contacts; and at least first and second electrodes located within said cavity, each of which is coupled to one of said contacts, bracketing said product.

27. A dielectric oven for heating a product within a tray, said oven comprising:

a housing which has a top wall, a bottom wall, and at least one side wall and includes a housing access and a housing access cover, defining a heating cavity;

a oven liner made from a non-electrically conductive material and having a liner top wall, a liner bottom wall, and at least one liner side wall, which substantially conform to and are in contact with said housing walls, including a liner access and a liner access cover, which substantially conform to said housing access and said housing access cover, respectively said liner defining a liner cavity within said heating cavity and forming a vaportight boundary between said liner cavity and said heating cavity;

at least a pair of contacts through said housing and said liner and into said cavity, such that said liner forms said vaportight boundary around said contacts;

an electromagnetic energy source including capacitor plates located outside of said housing and said liner coupled to and supplying current to each of said contacts; and at least first and second electrodes located within said cavity, each of which is coupled to one of said contacts, bracketing said product.

28. A dielectric oven for heating a product within a tray, said oven comprising:

a housing having a top wall, a bottom wall, at least one Side wall, a housing access, and a housing access cover, wherein said housing defines a heating cavity;

an oven liner made from a non-electrically conductive material and having a liner top wall, a liner bottom wall, and at least one liner side wall, wherein said oven liner walls substantially conform to and are in contact with said housing walls, and including a liner access and a liner access cover which conform to said housing access and said housing access cover, respectively, said liner defining a liner cavity within said heating cavity and forming a vaportight boundary between said liner cavity and said heating cavity;

at least one drain port located in said housing bottom wall and at least one drain guide formed in said liner bottom wall;

at least one intake port located in said at least one housing and liner side walls and at least one exhaust port located in said housing and liner top walls;

at least a pair of contacts projecting through said housing and said liner and into said liner cavity, such that said liner forms said vaportight boundary around said contacts;

an electromagnetic energy source including capacitor plates located outside of said housing and said liner coupled to and supplying current to each of said contacts; and at least first and second electrodes located within said cavity, each of said electrodes are substantially parallel to each other bracket said product and each of said at least first and second electrodes is coupled with one of said contacts.

* * * * *